US005575062A

United States Patent [19]

Nakajima et al.

[11] Patent Number: 5,575,062

[45] Date of Patent: Nov. 19, 1996

[54] METHOD FOR FORMING A CONNECTOR

[75] Inventors: Yasushi Nakajima; Ryo Kameoka, both of Kanagawa-ken, Japan

[73] Assignee: Kyocera Elco Corporation, Kanagawa-ken, Japan

[21] Appl. No.: 350,655

[22] Filed: Dec. 7, 1994

[30] Foreign Application Priority Data

Dec. 21, 1993 [JP] Japan ..... 5-322544

[51] Int. Cl.[6] ..... H01R 43/16

[52] U.S. Cl. ..... 29/874; 29/33 M; 29/882

[58] Field of Search ..... 29/874, 882, 884, 29/33 M

[56] References Cited

U.S. PATENT DOCUMENTS

| | | | |
|---|---|---|---|
| 3,587,502 | 6/1971 | Murray | 29/874 X |
| 3,707,932 | 1/1973 | Murray . | |
| 4,136,628 | 1/1979 | McGonigal et al. . | |
| 4,211,899 | 7/1980 | McGonigal et al. | 29/882 X |
| 4,638,559 | 1/1987 | McGonigal | 29/882 X |

FOREIGN PATENT DOCUMENTS

| | | | |
|---|---|---|---|
| 5-114452 | 5/1993 | Japan | 29/33 M |
| 5114453 | 5/1993 | Japan | 29/33 M |

*Primary Examiner*—Carl J. Arbes

[57] ABSTRACT

A method for forming a connector contact in which a workpiece is punched by a press to form a contact surface which includes steps of forming a provisional contact surface by a first punching operation of the workpiece, and forming a final contact surface by shaving the provisional contact surface. The provisional contact surface is subject to a split-shaving operation from the front and rear sides of the workpiece to separately shape the top and bottom halves of the provisional contact edge in the direction of the thickness of the workpiece to form the final contact surface.

4 Claims, 7 Drawing Sheets

METHOD FOR FORMING A CONNECTOR

BACKGROUND OF THE INVENTION

1. Field of the Invention

The present invention relates to an electrical contact which can be used for various connectors and a method for forming the same.

2. Description of the Related Art

In general, connector contacts are formed by pressing or punching a metal blank (electrically conductive plate). However, since a contact formed by such a conventional pressing (or punching) process leaves an irregular surface with small projections on the final punched edge, if the punched edge is then subject to metal plating, unevenness in the plating layer occurs due to the small projections and irregular surface. To this end, it is necessary for the punched edge to be subject to a secondary treatment or process to flatten or smooth the edges, prior to the plating.

Alternatively, in a known shaving process in which a blank is punched by upper and lower punching dies that are located as close as possible, the punched surface is smooth and flat enough to be used as a contact surface without the secondary flattening or smoothing treatment or process. Nevertheless, in .this conventional shaving process, a provisional contact surface is formed by a single punching, and accordingly, the corner (edge) portions of the punched surface are usually at right angles. Consequently, if the contact surface comes into contact with a mating member to be associated therewith at an inclination angle, no surface contact therebetween takes place. Namely, only a line contact occurs at the edge portions, thus resulting in the formation of scratches on the contact surface of the mating member and a failure to make a good stable electrical contact.

SUMMARY OF THE INVENTION

It is an object of the present invention to provide a method for forming a contact having a smooth and flat contact surface by a continuous pressing method, without the need for a secondary flattening or smoothing process or treatment.

Another object of the present invention is to provide a connector contact having a smooth and flat contact surface, that is to be produced by the forming method mentioned above.

To achieve the object mentioned above, according to the present invention, there is provided a method for forming a contact for a connector in which a workpiece is punched by a press to form a contact surface which can be brought into contact with a mating member to be associated therewith, comprising the steps of forming a provisional contact surface by a first punching operation of the work piece, and forming a final contact surface by shaving the provisional contact surface, wherein the provisional contact surface is subject to a split-shaving operation from the front and rear sides of the workpiece to separately shape the upper and lower halves of the provisional contact surface in the direction of the thickness of the workpiece to form the final contact surface.

With the split-shaving, not only an extremely smooth and flat contact surface can be obtained, but also rounded smooth edges can be formed at the ends of the contact surface in the direction of the thickness of the workpiece.

The split-shaving operation can be carried out by a pair of first upper and lower dies and a pair of second upper and lower dies. Preferably, the pair of first upper and lower dies being provided with an upper and lower shaving surface, wherein one of the first upper die and first lower die being provided with a first recessed surface connected to the respective shaving surface thereto, one of the second lower and upper dies being opposed to the first upper or lower die being provided with the first recessed surface being provided with a second recessed surface connected to the respective shaving surface thereto. During a shaving operation by the first upper and lower dies, only a part of the provisional contact surface being shaved and a shape of the first recessed surface being reproduced on one side of an end edge of the provisional contact surface in a direction of the thickness of the workpiece. During the shaving operation by the second upper and lower dies, a remaining part of the provisional contact surface being shaved and a shape of the second recessed surface being reproduced on the other side of the end edge of the provisional contact surface in the direction of the thickness of the workpiece.

According to another aspect of the present invention, there is provided a contact for a connector which is produced by punching a workpiece in a predetermined shape by a press, including a contact surface defined by a punched portion, wherein the contact surface is split-shaved in which the workpiece is shaped twice in the direction of the thickness of the workpiece, so that end edges of the contact surface in the direction of the thickness of the workpiece are shaped into curved surfaces smoothly connected to the contact surface.

According to a further aspect of the present invention, there is provided a shaving method comprising steps of: forming a provisional shaving surface by a first punching operation of the workpiece; and forming a final shaved surface by shaving the provisional shaving surface; wherein the provisional shaving surface is subject to a split-shaving operation from the front and rear sides of the workpiece to separately shave the upper and lower halves of the provisional shaving edge in the direction of the thickness of the workpiece to form the final shaved surface.

The present disclosure relates to subject matter contained in Japanese patent application No. 5-322544 (filed on Dec. 21, 1993) which is expressly incorporated herein by reference in its entirety.

BRIEF DESCRIPTION OF THE DRAWINGS

The invention will be described below in detail with reference to the accompanying drawings, in which.

DESCRIPTION OF THE PREFERRED EMBODIMENT

Figure 1:
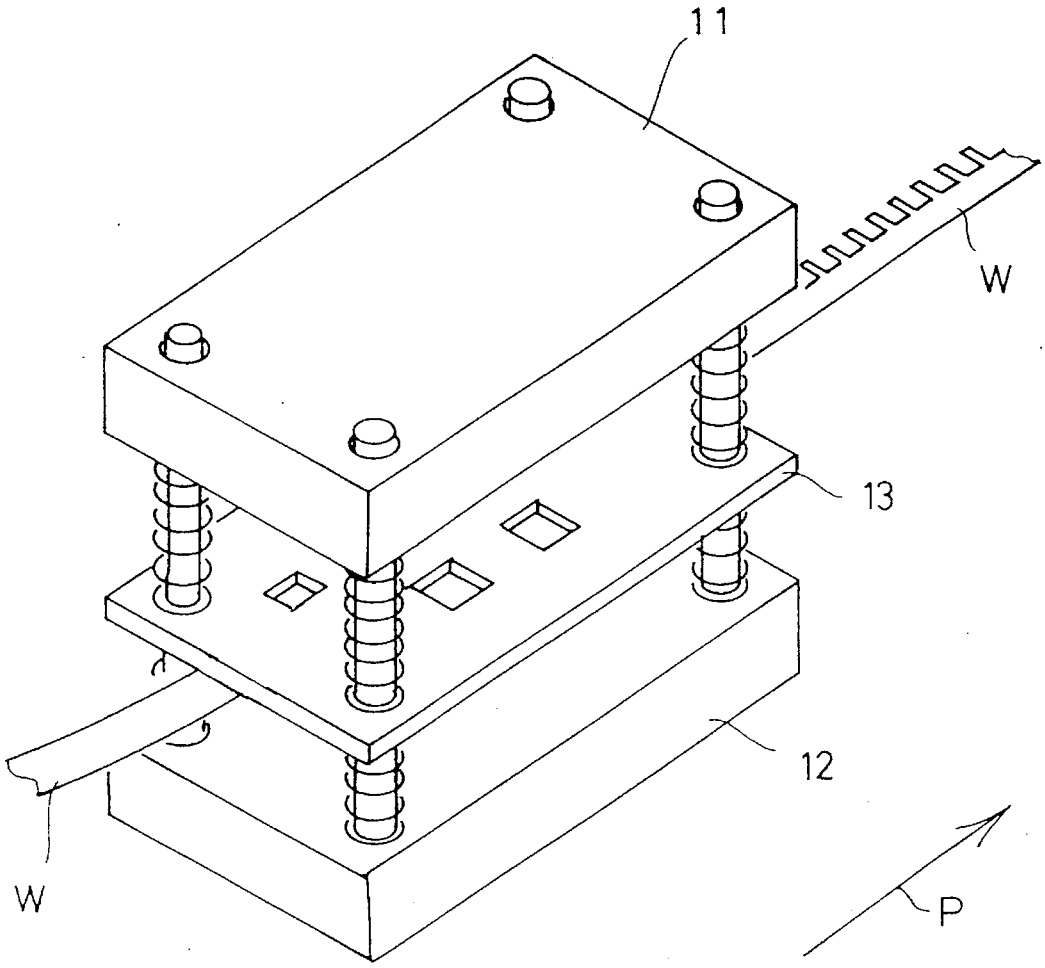
FIG. 1 is a isometric view of a press machine adapted to produce a connector contact according to the present invention.

FIG. 1 shows a conceptual view of a continuous press machine. In FIG. 1, the workpiece in the form of a strip W is held beneath a plate 13 (movable with the workpiece, perpendicular to the workpiece surface)is provided between an upper die (movable die) assembly 11 and a lower die (stationary die) assembly 12. The elongated strip W is intermittently fed at a predetermined pitch in the direction shown by the arrow P in FIG. 1. The upper and lower die assemblies 11 and 12 have a plurality of pairs of predetermined dies spaced at a pitch corresponding to the feed pitch. When the strip W moves the die assemblies 11 and 12 complete successive press operations.

Figure 10:
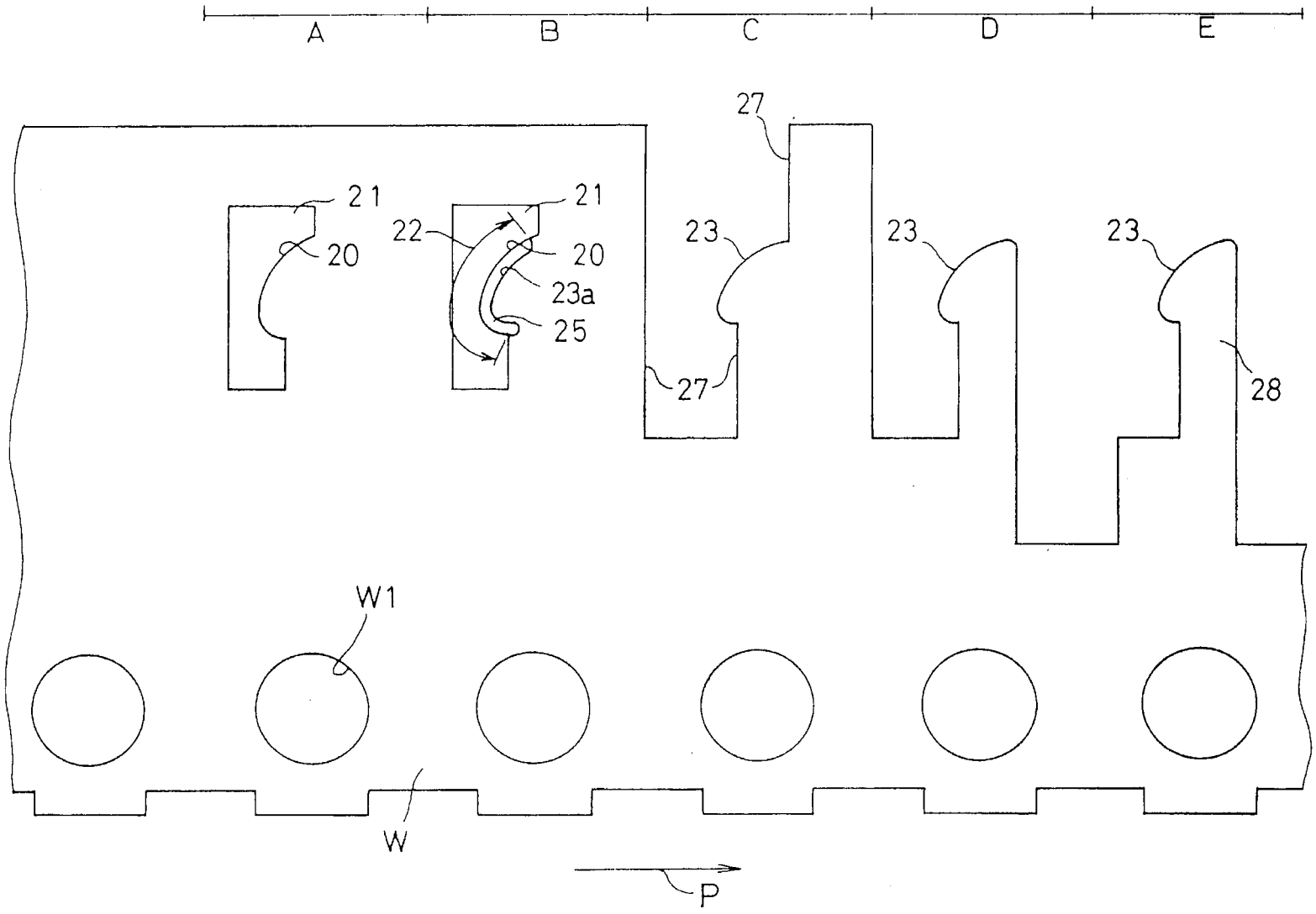

FIG. 10 shows the successive press operations to which the workpiece W is to be subject. The workpiece W is provided with feed holes W1 spaced at a predetermined pitch. In the illustrated embodiment, a punching operation 21 is effected at the first station "A" to punch a predetermined shape including a provisional contact surface 20 by a conventional manner. The provisional contact surface 20 is a curved surface.

Figure 3:
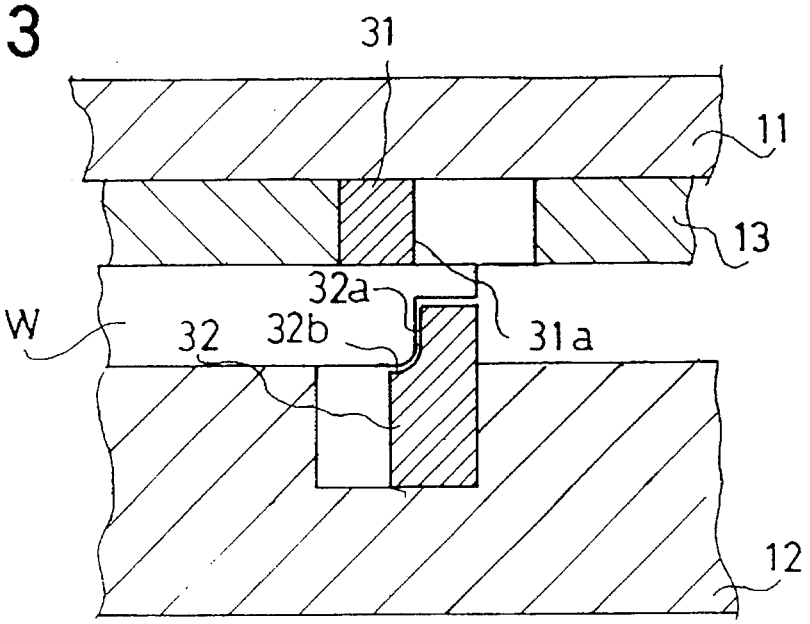
FIG. 3 is a longitudinal sectional view of a first upper die and a first lower die, shown in a position different from FIG. 2.
Figure 2:
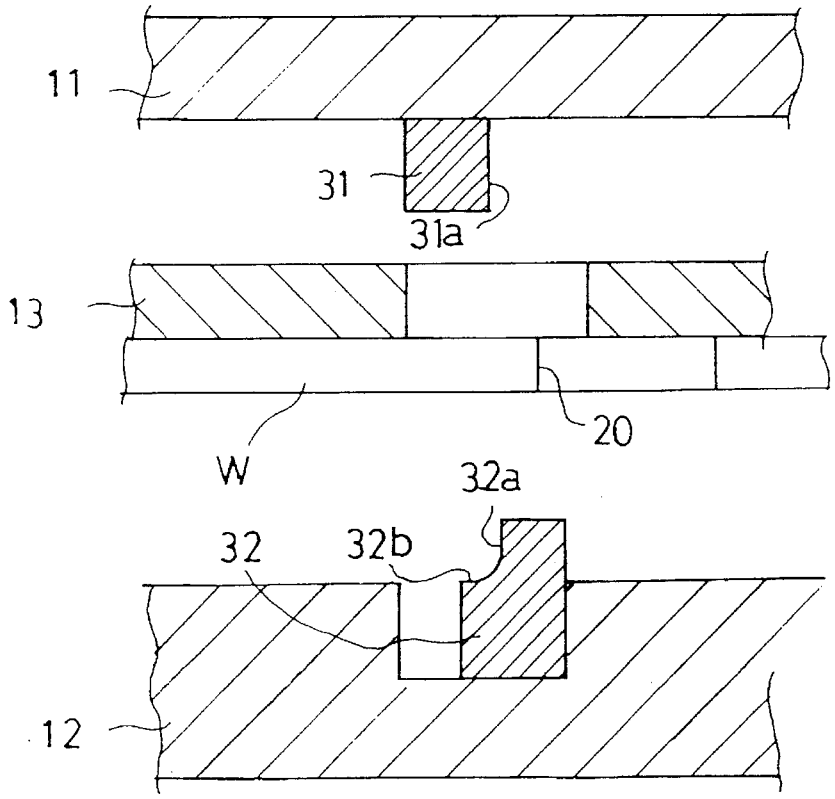
FIG. 2 is a longitudinal sectional view of a first upper die and a first lower die, used in the present invention, by way of example.
Figure 5:
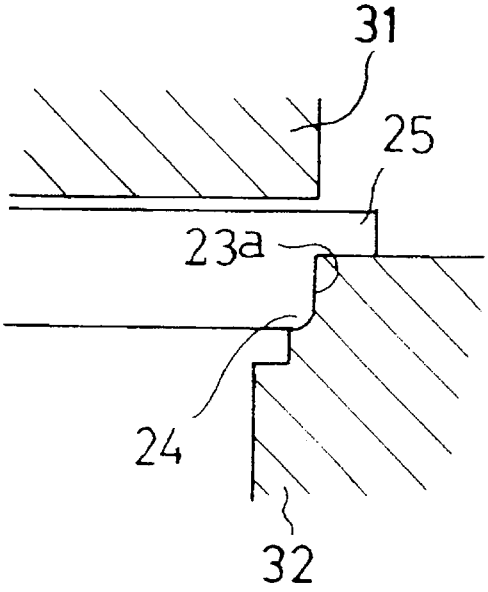
FIG. 5 is a partial sectional view of a first upper die and a first lower die to explain the shaving operation, shown in an operative position different from FIG. 4.
Figure 4:
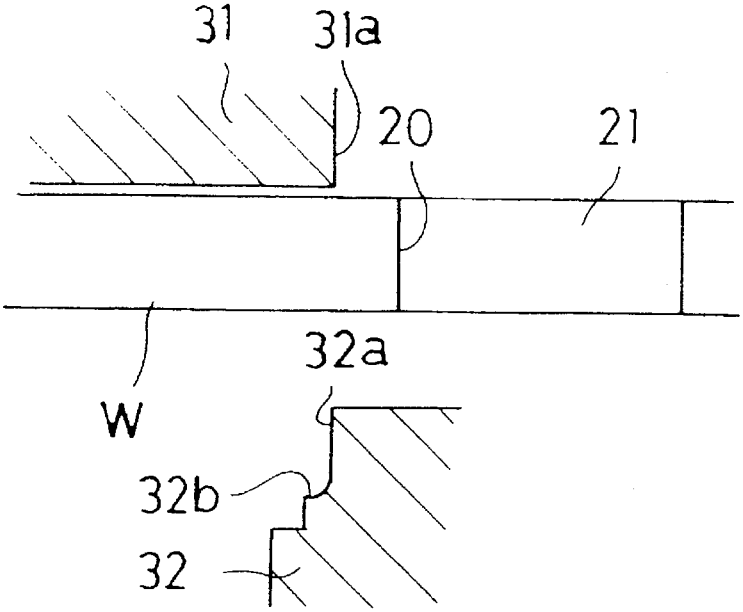
FIG. 4 is a partial sectional view of a first upper die and a first lower die to explain the shaving operation.
Figure 6:
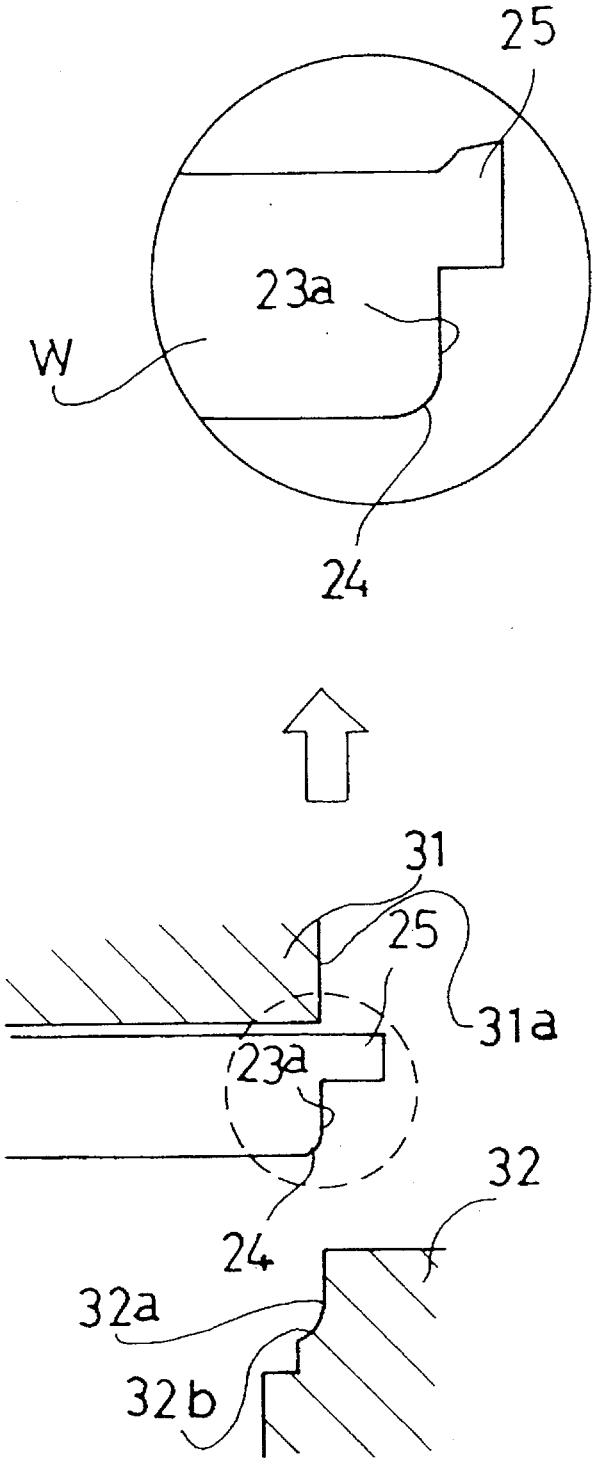
FIG. 6 is a partial sectional view of a first upper die and a first lower die to explain the shaving operation, shown in an operative position different from FIGS. 4 and 5.

In the second and third stations B and C, the provisional contact surface 20 is subject to a split-shaving (double-shaving) operation. FIGS. 2 through 6 show the successive steps of the split-shaving at the second station B. Note that in FIGS. 4 through 6, the support plate 13 is omitted only for clarity. FIGS. 2 and 3 show schematic sectional views showing a positional relationship of the upper die assembly 11, the lower die assembly 12, the support plate 13, and the workpiece W. FIGS. 4 and 5 show enlarged partial sectional views of FIGS. 2 and 3.

At the station B, the pressing is carried out by a first upper die 31 of the upper die assembly 11 and a first lower die 32 of the lower die assembly 12. The first upper and lower dies 31 and 32 are respectively provided with the shaving surfaces 31*a* and 32*a* that substantially overlap in a plan view (i.e., with no clearance therebetween in the direction of the length of the elongated workpiece W). The first lower die 32 is also provided with a first curved recessed surface 32*b* below the shaving surface 32*a* to be connected thereto. The first recessed surface 32*b* is adapted to form a round or curved lower edge of the provisional contact surface 20 in the thickness direction of the workpiece W. The shaving surface 31*a* of the first upper die 31, and the shaving surface 32*a* and the first recessed surface 32*b* of the first lower die 32 extend over the range 22 of the provisional contact surface 20 shown in FIG. 10. The range 22 of the provisional contact surface 20 defines a final contact surface.

At the station B, the shaving is carried out by the shaving surfaces 31*a* and 32*a* to cut away a lower part of the provisional contact surface 20 by approximately half the thickness of the workpiece W to form a lower final contact surface 23*a* whose vertical length is approximately equal to half the thickness of the workpiece W. At the same time, the shape of the first recessed surface 32*b* is reproduced on a part (lower edge) of the provisional contact surface 20 in the direction of the thickness of the workpiece W to form the round corner edge 24. In this pressing operation, since no shaving of the upper half of the provisional contact surface 20 is carried out, the upper half of the provisional contact surface 20 defines a front edge portion 25 that has not been subject to the shaving.

Figure 8:
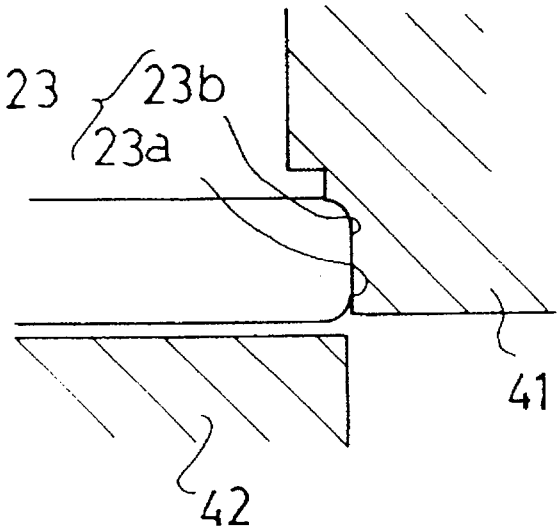
FIG. 8 is a partial sectional view of a second upper die and a second lower die to explain the shaving operation thereof, shown in an operative position different from FIG. 7.
Figure 7:
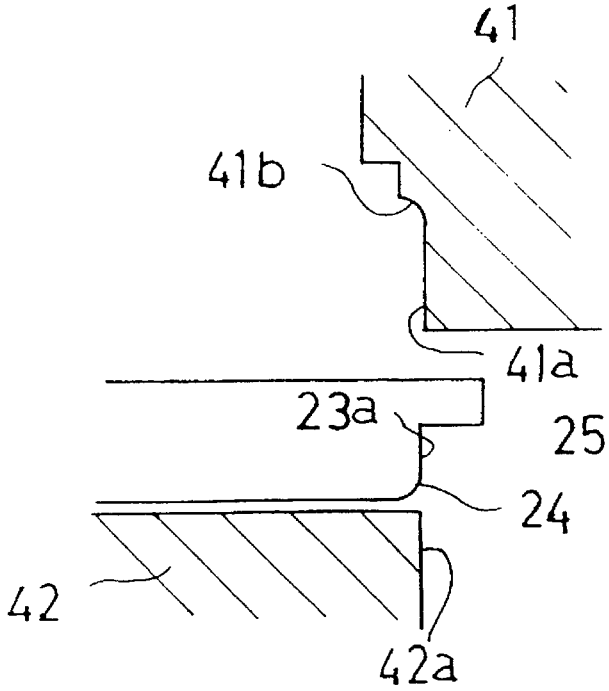
FIG. 7 is a partial sectional view of a second upper die and a second lower die to explain a shaving operation thereof.
Figure 9:
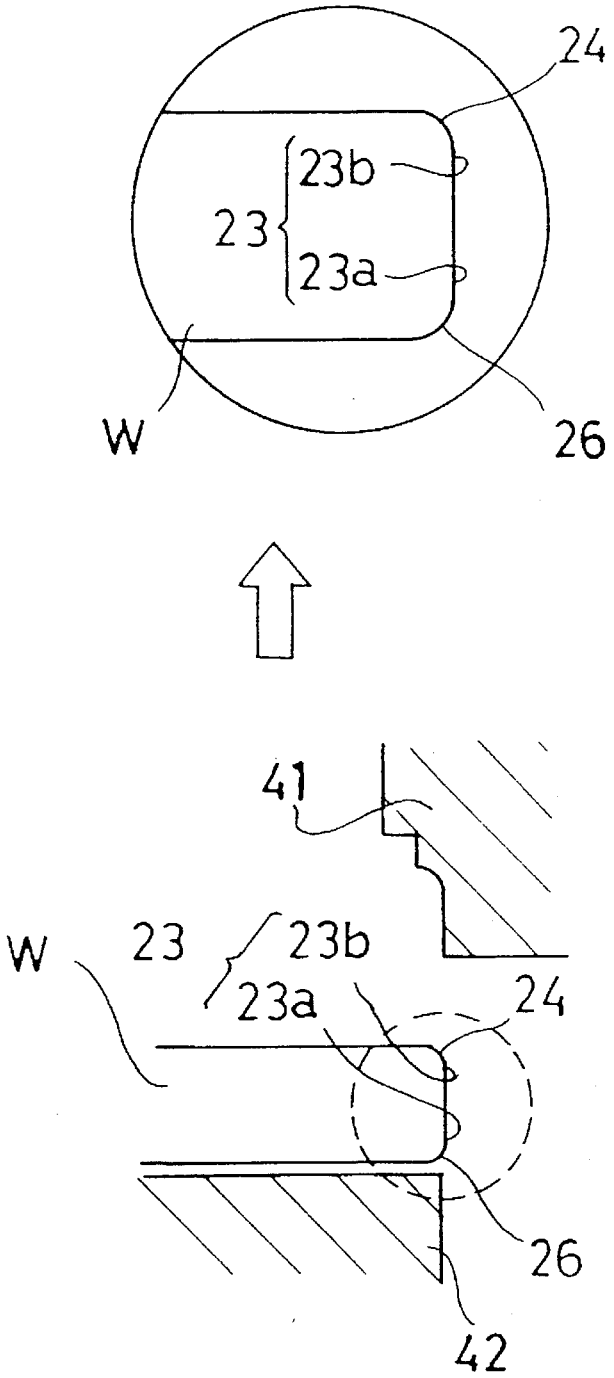
FIG. 9 is a partial sectional view of a second upper die and a second lower die to explain the shaving operation thereof, shown in an operative position different from FIGS. 7 and 8; and, FIG. 10 is a schematic view of the continuous pressing processes, according to the present invention.

At the station C, a second upper die 41 of the upper die assembly 11 and a second lower die 42 of the lower die assembly 12 are used to shape the workpiece, as can be seen in FIGS. 7 through 9. The second upper and lower dies 41 and 42 are respectively provided with shaving surfaces 41*a* and 42*a* that substantially overlap in a plan view (i.e., with no clearance therebetween in the direction of the length of the elongated workpiece W). The shaving surface 41*a* of the second upper die 41 and the shaving surface 42*a* of the second lower die 42 correspond to the shaving surface 32*a* of the first lower die 32 and the shaving surface 31*a* of the first upper die 31, respectively. Namely, the correlation of the shaving surfaces 31*a* and 32*a* of the first pair of dies 31 and 32 is inverted to the correlation of the shaving surfaces 41*a* and 42*a* of the second pair of dies 41 and 42. The second upper die 41 is also provided with a second curved recessed surface 41*b* above the shaving surface 41*a* to be connected thereto. The second recessed surface 41*b* is adapted to form a round or curved upper edge of the provisional contact surface 20 in the width direction of the workpiece W. The shaving surface 41*a* and the second recessed surface 41*b* of the second upper die 41, and the shaving surface 42*a* of the second lower die 42 extend over the range or section 22 (FIG. 10) of the provisional contact surface 20 that defines the final contact surface, similar to the shaving surface 31*a* of the first upper die 31, and the shaving surface 32*a* and the first recessed surface 32*b* of the first lower die 32.

At the station C, the shaving is carried out by the shaving surfaces 41*a* and 42*a* to cut away an upper part of the provisional contact surface 20 by approximately half the thickness of the workpiece W to form an upper final contact surface 23*b* whose vertical length is approximately equal to half the thickness of the workpiece W. The upper final contact surface 23*b* is correctly flush with the lower final contact surface 23*a* that has been produced at station B, so that an entirely smooth final contact surface 23 can be formed. During the shaving at station C, the front edge portion 25 that has not been subject to the shaving at station B is removed from the final contact surface 23. Also, during the shaving at station C, the shape of the second recessed surface 41*b* is copied on a part (upper edge ) of the provisional contact surface 20 in the direction of the thickness of the workpiece W to form a round corner edge 26. During this pressing operation, the surrounding portion of the final contact surface 23 is punched as indicated at 27 in FIG. 10.

At stations D and E, another punching operation is carried out to form a contact for a connector. Namely, when the workpiece W is discharged from the upper and lower die assemblies 11 and 12, the contact 28 is completed. The contact 28 is thereafter cut and separated from the workpiece W to obtain a final product 28.

Since the final contact surface 23 of the contact 28 is formed by the double-shaving (split-shaving) process from the front and rear sides of the workpiece, the final contact surface 23 can be made extremely smooth. In addition, since the final contact surface 23 is provided with round edges 24 and 26 at the opposed corners thereof in the thickness direction of the workpiece, formed by the first and second recessed surfaces 32*b* and 41*b* of the first lower die 32 and the second upper die 41, respectively, a stable contact of the real contact surface with a mating member to be associated therewith can be ensured. For example, if the final contact surface 23 of the contact 28 is formed by one shaving process as in the prior art, the corner edges of the real contact surface 23 in the direction of thickness of the workpiece are right-angled edges, so that even a small inclination of the final contact surface 23 fails to establish sufficient surface contact. However, in the present invention, since the final contact surface is provided with a round or curved corner edges on both sides, a stable surface contact and sufficient contact pressure can be ensured even if there is an inclination of the final contact surface 23 with respect to its mating member. The shape of the first and second recessed surfaces 32*b* and 41*b* can be optionally selected.

As can be seen from the above discussion, according to the present invention, since the final contact surface is formed by the double-shaving operation of the provisional contact surface in which the workpiece is subject to two shaving processes from the front and rear sides of the workpiece in the direction of the thickness thereof, an extremely smooth contact surface can be obtained.

Moreover, the contact surface can be provided with the desired shape of corner edges in the thickness direction of the workpiece. Consequently, even if the contact surface is inclined with respect to a mating member to be associated therewith, a stable surface contact and a sufficient contact pressure can be obtained.

What is claimed is:

1. A method for forming a contact for a connector in which a workpiece, in the form of a piece of material having upper and lower sides and a thickness dimension extending generally perpendicularly to said upper and lower sides, is punched by a press to form a contact surface extending in said thickness dimension which contact surface can be brought into contact with a mating member to be associated therewith, comprising;

forming a provisional contact surface extending in said thickness dimension by a first punching operation of the workpiece; and, forming a final contact surface by shaving said provisional contact surface;

in which shaving said provisional contact surface is subjected to a split-shaving operation from both of said upper and lower sides of the workpiece to separately shave upper and lower halves of the provisional contact surface in the direction of the thickness of the workpiece to form a final contact surface.

2. A contact forming method according to claim 1, wherein said split-shaving operation is carried out by using a first pair of upper and lower dies having upper and lower shaving surfaces, respectively, and a second pair of upper and lower dies having upper and lower shaving surfaces, respectively;

one of said dies of said first pair of dies having a first recessed surface connected to said shaving surface of said one die;

one of said dies of said second pair of dies being opposed to said one die of said first pair of dies and having a second recessed surface connected to said shaving surface of said one die of said second pair of dies;

during the shaving operation by said first pair of dies, only a part of said provisional contact surface being shaved and the shape of said first recessed surface being reproduced on one side of said final contact surface in the direction of the thickness of the workpiece; and during the shaving operation by said second pair of dies, a remaining part of said provisional contact surface being shaved and the shape of said second recessed surface being reproduced on the other side of said final contact surface in said direction of the thickness of the workpiece.

3. A shaving method for forming a final shaved surface on a workpiece having upper and lower sides and a thickness dimension extending between said upper and lower sides, said method comprising the steps of:

forming a provisional shaving surface by a first punching operation of the workpiece, said provisional shaving surface extending between said upper and lower sides in said thickness direction and having upper and lower halves; and, forming a final shaved surface by shaving said provisional shaving surface;

wherein, in said forming of said final shaved surface said provisional shaving surface is subjected to a split-shaving operation from both of said upper and lower sides of the workpiece to separately shave said upper and lower halves of said provisional shaving surface in the direction of the thickness of the workpiece to form said final shaved surface.

4. A shaving method according to claim 3, wherein said split-shaving operation is carried out by using a first pair of upper and lower dies having upper and lower shaving surfaces, respectively, and a pair of second upper and lower dies having upper and lower shaving surfaces, respectively;

one of said dies of said first pair of dies having a first recessed surface connected to said shaving surface of said one die;

one of said dies of said second pair of dies having a second recessed surface connected to said shaving surface of said one die of said second set of dies;

during the split-shaving operation by said first pair of dies only a part of said provisional shaving surface being shaved and the shape of said first recessed surface being reproduced on one side of said final shaved surface in the direction of the thickness of the workpiece; and during said split-shaving operation by said second pair of dies a remaining part of said provisional shaving surface being shaved and the shape of said second recessed surface being reproduced on the other side of said final shaved surface in the direction of the thickness of the workpiece to form said final shaved surface.

* * * * *